United States Patent [19]

Asaeda et al.

[11] 3,973,925

[45] Aug. 10, 1976

[54] MANUFACTURING PROCESS FOR A METAL BONDED GRINDING TOOL AND THE METAL BONDED GRINDING TOOL PRODUCED THEREBY

[75] Inventors: Toshio Asaeda, Tokyo; Ikuo Suzuki, Chiryu; Tomoyasu Imai, Kariya, all of Japan

[73] Assignees: Toshio Asaeda, Tokyo; Toyoda Koki Kabushiki Kaisha, both of Japan; part interest to each

[22] Filed: Mar. 20, 1974

[21] Appl. No.: 453,061

[30] Foreign Application Priority Data

Mar. 20, 1973 Japan ..... 48-31366

[52] U.S. Cl. ..... 51/295; 51/309 R

[51] Int. Cl.[2] ..... B24D 3/10

[58] Field of Search ..... 51/309, 295, 296, 308, 51/307; 29/420

[56] References Cited

UNITED STATES PATENTS

| | | | |
|---|---|---|---|
| 3,293,012 | 12/1966 | Smiley et al. | 51/295 |
| 3,369,879 | 2/1968 | Miller | 51/293 |
| 3,588,992 | 6/1971 | Asaeda et al. | 29/420 |
| 3,650,714 | 3/1972 | Farkas | 51/309 |
| 3,762,895 | 10/1973 | Keeleric | 51/295 |
| 3,779,726 | 12/1973 | Fisk et al. | 51/295 |
| 3,820,966 | 6/1974 | Sejbal et al. | 51/295 |
| 3,841,852 | 10/1974 | Wilder et al. | 51/309 |

*Primary Examiner*—Donald J. Arnold
*Attorney, Agent, or Firm*—Oblon, Fisher, Spivak, McClelland & Maier

[57] ABSTRACT

A manufacturing process for a metal bonded grinding tool includes the steps of; (a) preparing a rim of porous material, (b) press-forming the abrasive grains in contact with the rim to a specified structural dimension, and (c) forcibly passing a chemical plating liquid through a contacting body of the abrasive grains and the rim obtained in step (b) for continuously making the metal precipitate on the surfaces of the abrasive grains and in the pores of the rim so as to uniformly and continuously bond therebetween in any grinding tool of desired dimension.

17 Claims, 4 Drawing Figures

MANUFACTURING PROCESS FOR A METAL BONDED GRINDING TOOL AND THE METAL BONDED GRINDING TOOL PRODUCED THEREBY

BACKGROUND OF THE INVENTION

1. Field of the Invention

The present invention relates to a manufacturing method for a metal bonded grinding tool and the metal bonded grinding tool produced thereby.

2. Description of the Prior Art

As a prior art method for manufacturing a metal bonded grinding wheel, the manufacturing method disclosed in U.S. Pat. No. 3,588,992 to Asaeda et al is known, which method includes the steps of:

a. a preliminary pretreating step in which abrasive grains have their surfaces cleaned and prepared for subsequent metal coating;

b. a press-forming step in which the abrasive grains pretreated in (a) are press-formed to specified structural dimension;

c. a bond metal coating step in which the press-formed abrasive grains obtained in step (b) are placed in a solution containing a metallic salt and the solution is forcibly passed through the spaces between the abrasive grains, whereby making the metal precipitate on the surfaces of the abrasive grains and binding these abrasive grains with the precipitated metal; and d. a heat treatment step for crystallizing the precipitated metal.

Generally, the grinding wheel made by the foregoing steps has a thickness T larger than the width W as shown in FIG. 1, $$\text{Width: } W < \text{Thickness; } T \qquad (1)$$

and in the foregoing step (c), as shown in FIG. 3, a press-formed body, that is, the grinding wheel portion 3 of the abrasive grains provided around a rim 2 which holds a centering metal 8 at the center thereof is provided in a frame 1 coaxially thereto, and the frame 1 is sealingly held by an upper body 4 and a lower body 5. Solution is introduced through a conduit 6 connected to the lower body 5 and is forcibly passed through the spaces between the press-formed abrasive grains in an axial direction of the grinding wheel portion 3. That is, the solution moves in a direction shown by the arrow marks, and is finally exhausted from an outlet conduit 7 which is provided on the upper body 4, whereby the metal is precipitated on the surfaces of the abrasive grains. In the prior art grinding wheel, the rim 2 is made of a usual solid metal such that the solution can be passed in the axial direction of the grinding wheel only through the spaces among the abrasive grains. However, uniformity of the bonding metal can be obtained by the foregoing solution supply method while the relationship shown in the above formula 1 holds good, because the solution passage area is relatively wide. On the contrary, in the case that it is required to bond a diamond grinding wheel, shown in FIG. 3, which grinding wheel has the following dimensional relationship:

Grinding wheel width:

$$W > \text{Grinding wheel thickness: } T \qquad (2)$$

it is inadequate to adopt the above noted prior solution supply method, in which the solution is passed through the grinding wheel portion 3 in an axial direction of the grinding wheel, because the precipitated bonding layer is apt to become uneven in the axial direction of the grinding wheel. This is because the solution can only pass through the grinding wheel portion which is thin in thickness (T) and wide in width (W) in the axial direction thereof. In addition, it is desired that the grinding wheel portion 3 is strongly affixed to the rim 2 in accordance with the development of heavy and high speed grinding by the diamond grinding wheels. However, in accordance with the foregoing prior technique, there is a further defect that it is unavoidable to generate a boundary portion between the rim 2 and the grinding wheel portion 3, and thus, the bonding force therebetween becomes weak.

SUMMARY OF THE INVENTION

Accordingly, it is an object of the present invention to provide an improved manufacturing process for a metal bonded grinding tool and the metal bonded grinding tool produced thereby which enables uniform metal bonding in all kinds of grinding wheels.

Another object of the present invention is to provide a manufacturing process and grinding wheel produced thereby in which the grinding wheel portion is continuously bonded to the rim thereof by precipitated metal and is durable in high speed and heavy grinding operations.

The foregoing and other objects of the present invention are obtained in accordance with one aspect of the present invention through the provision of a manufacturing process for a metal bonded grinding tool having the steps of, (1) a preliminary pretreating step in which abrasive grains have their surfaces cleaned and prepared for subsequent metal coating, (2) a press forming step in which the abrasive grains pretreated in step (1) are press-formed to specified structural dimensions, (3) a bond metal coating step in which the press-formed abrasive grains obtained in step (2) are placed in a chemical plating liquid and the chemical plating liquid is forcibly passed through the spaces between the abrasive grains, whereby making the metal precipitate on the surfaces of the abrasive grains and bonding the abrasive grains with the precipitated metal, and (4) a heat treatment step for crystallizing the precipitated metal, the improvement including the steps of: (a) preparing a rim of porous materials; (b) press-forming abrasive grains in contact with the rim of porous material to a specified structural dimension; and (c) forcibly passing a chemical plating liquid through a contacting body of abrasive grains and rim of porous material obtained in step (b) for continuously making the metal precipitate on the surfaces of the abrasive grains and in the pores of the rim of porous material so as to uniformly and continuously bond therebetween in any grinding tool of desired dimension.

BRIEF DESCRIPTION OF THE DRAWINGS

Various other objects, features and attendant advantages of the present invention will be more fully appreciated as the same becomes better understood from the following detailed description of a preferred embodiment when considered in connection with the accompanying drawings in which.

DETAILED DESCRIPTION OF A PREFERRED EMBODIMENT

Figure 1:
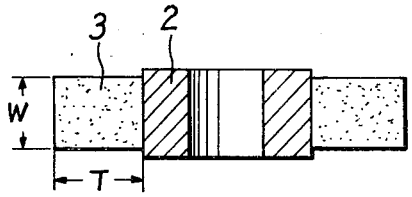
FIG. 1 is a sectional view of a general grinding wheel for explaining the dimension thereof.
Figure 2:
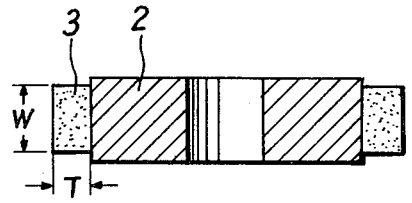
FIG. 2 is a sectional view of a grinding wheel having a rim for explaining the dimension thereof.
Figure 3:
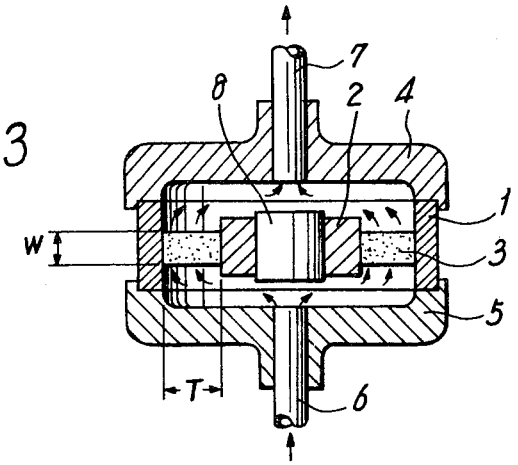
FIG. 3 shows a prior method for metal bonding of the grinding wheel.
Figure 4:
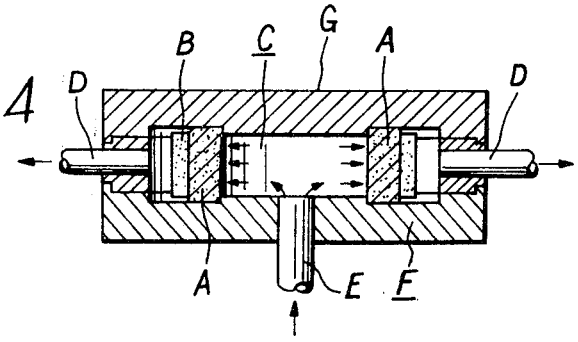
FIG. 4 shows a bonding method in a manufacturing process for a metal bonded grinding wheel having a rim in accordance with the present invention.

As the abrasive grains B, as shown in FIG. 4, the following substances can be used: diamond, boron nitride, Alundum, white Alundum, Carborundum, green Carbolundum, and the like. Of course, it would be possible to employ grains, which are a mixture with appropriate proportions of diamond, boron nitride, Alundum, Carborundum or the like.

The first step in this process is a pretreatment for the metal coating on the surfaces of the abrasive grains B, that is, the metal coating pretreatment. In this metal coating pretreatment step, the grains B are generally acid and alkali-washed to remove grease and impurities from their surfaces. They are then subjected to a sensitizing treatment as a preparatory process so that catalyzer metal molecules can be uniformly deposited on the surfaces. Thereafter, an activating treatment on the surfaces is performed for uniformly depositing the catalyzer metal molecules thereon. Depending upon the circumstances, the pretreatment for metal coating may be acid-washing and alkali-washing alone.

In this embodiment, as an example, the abrasive grains are 45 g. of 60 mesh diamond and are pretreated for metal coating as follows:

1. Acid-washing, alkali-washing
   i. Boiling for 10 minutes in 500cc. of hydrochloric acid (HCl),
   ii. Washing with distilled water,
   iii. Boiling for 10 minutes in 500cc. of 5% aqueous solution of caustic soda (Na OH),
   iv. Washing with distilled water.
2. Sensitizing treatment
   i. Immersing in 300cc. of aqueous solution of tin chloride ($SnCl_2$) prepared by mixing at a ratio of Sn $Cl_2$ 10g., HCl 40cc. and distilled water ($H_2O$) 1000cc; and stirring for 5 minutes at room temperature,
   ii. Washing lightly with distilled water.
3. Activating treatment
   i. Immersing in 3000cc. of aqueous solution of palladium chloride ($PdCl_2$) prepared by mixing at a ratio of $PdCl_2$ 1g., HCl 10cc., $H_2O$ 4000cc., and stirring for 5 minutes at room temperature,
   ii. Washing lightly with distilled water.

By this treatment, palladium moleculars, as the catalyzer, are uniformly deposited on the surfaces of the abrasive grains.

At the same time, a rim A of porous material is prepared in accordance with the following steps. The porous material is, for example, a sintered alloy of bronze Cu-Sn (Cu 90, Sn 10) or of Fe (iron) system sintered alloys and is formed into a ring which includes spaces therein through which a substance of the size of $10\mu$ to $40\mu$ can pass. The outer cylindrical surface of the porous rim A is turned for correcting the shape thereof, and is then treated by etching for recovering the porous outer surface thereof, which is injured by the turning operation. Thereafter, it is washed as follows; acetone-washing for removing fats or oils, then alkali-washing by immersing in an aqueous solution of ortho sodium silicate 3%, sodium hydroxide 5%, boiling for an hour, washing with distilled water, thereafter acid-washing by immersing in an aqueous solution of 10% of hydrochloric acid for 5 to 10 minutes at room temperature, and then washing with distilled water again. Following this operation, this rim A is immersed in the later described nickel chemical plating liquid for precipitating nickel on the surface thereof including surfaces defining the pores. This nickel precipitating treatment is performed to prevent the oxidation of the washed rim A when it is disposed in air for a long time. Thus, it is to be noted that this nickel precipitating treatment is not necessarily required under some conditions.

The precipitated abrasive grains are supplied and press-formed surrounding rim A, and as is shown in FIG. 4, arranged in a box body F coaxially thereto, which box body is provided with an inlet conduit E at the center thereof and outlet conduits D, D at the side wall thereof. The box body F is sealingly covered by a cap body G and a solvent, including a metallic salt (metallic salt solution), is supplied from the inlet conduit and is forcibly passed through the rim A and the press-formed abrasive grains in the radial direction thereof. In addition, it is to be noted that the direction of the solution passing through the rim and the abrasive grains is not limited to the above and many modifications are, of course, possible.

There are many types of metallic salt solutions, but the nickel chemical plating liquid is used as an example of this embodiment since nickel has been previously precipitated on the porous rim A. The composition of the nickel chemical plating liquid is given as follows:

Nickel chloride ($NiCl_2 \cdot 6H_2O$) 30g./1.

Sodium hypophosphite ($NaH_2PO_2 \cdot H_2O$) 10g./1.

Sodium acetate ($CH_3COONa \cdot 3H_2O$) 50g./1.

and HCl is added to adjust the hydrogen exponenet pH to 4.5–5.5 value.

In the present example of this embodiment, when 2l of nickel chemical plating liquid with the above-mentioned composition is used at a temperature of 90°–95°C, and the plating time is 1 hour, and the plating liquid is supplied through the conduit E at a rate of 0.4 l./min. 2g. of bond metal (nickel) can be precipitated.

Thereafter, a heat treatment is performed, in accordance with a well-known manner, for changing the non-crystalline precipitated nickel into the crystalline.

Among others, the following features are obtained in the present invention. A uniform metal bonding characteristic can be obtained for all dimensional grinding wheels even if the width W is larger than the thickness T, because the chemical plating liquid can pass through the rim A and the press formed abrasive grains especially when the plating liquid is supplied in a radial direction of the rim. The abrasive grains can be strongly bonded on the rim because the surface area of the rim is based wide enough upon the unevenness effected by the etching operation and the porosity thereof. Moreover, there is no boundary portion between the rim and the abrasive grains because the plating liquid is supplied through the rim and the abrasive grains in a radial direction thereof. In addition, it is possible to get a rim which is fully durable against the normal severe force at the time of a heavy and high speed grinding operation since the pores of the rim can be filled by the chemical plating metal when the plating liquid is passed therethrough in the radial direction and outwardly. Furthermore, as the bonding layer is all metallic high electric conductivity can be obtained at the portion of the rim and the abrasive grains and therefore, a grinding wheel which is suitable for electrolytic grinding can be obtained.

Obviously, numerous modifications and variations of the present inventon are possible in light of the above teachings. It is to be understood therefore that within the scope of the appended claims, the present invention may be practiced otherwise than as specifically described herein.

What is claimed as new and desired to be secured by Letters Pat. of the U.S. is:

1. In a manufacturing process for a metal bonded grinding tool comprising the steps of (1) preliminary pretreating in which abrasive grains have their surfaces cleaned and prepared for subsequent metal coating, (2) press-forming in which said abrasive grains pretreated in step (1) are press-formed to specified structural dimensions, (3) bond metal coating in which said press-formed abrasive grains obtained in step (2) are placed in a chemical plating liquid and said chemical plating liquid is forcibly passed through the spaces between said abrasive grains, whereby the metal is precipitated on the surfaces of said abrasive grains and said abrasive grains are bonded with said precipitated metal, and (4) heat treating for crystallizing said precipitated metal, the improvement comprising the steps of:

a. preparing a rim of porous material formed from a sintered alloy;

b. press-forming abrasive grains in contact with said rim of porous material to a specified structural dimension; and c. forcibly passing a nickel chemical plating liquid through and radially out of a contacting body of said abrasive grains and said rim of porous material obtained in step (b) for continuously making the metal precipitate on the surfaces of said abrasive grains, but not completely filling the interstices defined therebetween, and in the pores of said rim of porous material so as to bond said abrasive grains uniformly in an axial direction of said rim and continuously bond said abrasive grains and said rim.

2. A manufacturing process according to claim 1, wherein said rim of porous material is formed in a cylindrical shape.

3. A manufacturing process according to claim 1, wherein said rim of porous material is of Cu-Sn sintered alloy.

4. A manufacturing process according to claim 2, wherein said abrasive grains are press-formed around the outer cylindrical surface of said rim of porous material in a form of predetermined uniform width and thickness.

5. A manufacturing process according to claim 4, wherein said chemical plating liquid is supplied from an inner portion of said rim therethrough in an outer direction thereof and then through said press-formed abrasive grains in said step (c).

6. A manufacturing process according to claim 5, wherein the forcible passing of said chemical plating liquid in said step (c) is continued until said pores of said rim are filled with the metal precipitated thereby.

7. A manufacturing process according to claim 2, wherein the outer cylindrical surface of said rim is turned for correcting the cylindrical shape thereof and then said rim is etched until said pores on said rim crushed in the prior turning step are recovered thereon.

8. A manufacturing process according to claim 7, wherein said rim is immersed in an aqueous solution of HCl for a predetermined period of the etching thereof.

9. A manufacturing process according to claim 7, further comprising a step in which said chemical plating liquid is supplied to said rim after the etching operation thereon for plating the same so as to prevent oxidation thereof.

10. A manufacturing process according to claim 7, wherein said abrasive grains are press-formed around the outer cylindrical surface of said rim after the chemical plating on said rim in a form of predetermined dimension.

11. A manufacturing process according to claim 10, wherein said chemical plating liquid is supplied from an inner portion of said rim therethrough in an outer direction thereof and then through said press-formed abrasive grains in said step (c).

12. A manufacturing process according to claim 11, wherein the forcible passing of said chemical plating liquid in said step (c) is continued until said pores of said rim are filled with the metal precipitated thereby.

13. A metal bonded grinding tool comprising:

a rim formed from a sintered alloy;

abrasive grains press-formed in contact with said rim; and a nickel plated layer disposed upon the surfaces of said abrasive grains and within said rim throughout the entire extent thereof so as to continuously bond said rim and said abrasive grains together and to bond said abrasive grains uniformly in the axial direction of said rim, said layer only partially filling the interstices defined between said abrasive grains.

14. A metal bonded grinding tool according to claim 13, wherein said rim is formed in a cylindrical shape and said abrasive grains are provided around the outer cylindrical surfaces of said rim.

15. A metal bonded grinding tool according to claim 14, wherein the thickness of said abrasive grains is smaller than the width of the same.

16. A metal bonded grinding tool according to claim 15, wherein said abrasive grains are of diamond.

17. A metal bonded grinding tool according to claim 16, wherein said rim of porous material is of Cu-Sn sintered alloy.

* * * * *